US009080572B2

(12) United States Patent
Murray

(10) Patent No.: US 9,080,572 B2
(45) Date of Patent: Jul. 14, 2015

(54) CENTRIFUGAL PUMP WITH SECONDARY IMPELLER AND DUAL OUTLETS

(71) Applicant: William E. Murray, Sugar Land, TX (US)

(72) Inventor: William E. Murray, Sugar Land, TX (US)

( * ) Notice: Subject to any disclaimer, the term of this patent is extended or adjusted under 35 U.S.C. 154(b) by 280 days.

(21) Appl. No.: 13/724,759

(22) Filed: Dec. 21, 2012

(65) Prior Publication Data

US 2013/0183137 A1 Jul. 18, 2013

Related U.S. Application Data

(60) Provisional application No. 61/578,928, filed on Dec. 22, 2011.

(51) Int. Cl.

| | |
|---|---|
| ***F04D 1/08*** | (2006.01) |
| ***F04D 29/42*** | (2006.01) |
| ***F04D 1/06*** | (2006.01) |
| ***F04D 13/14*** | (2006.01) |

(52) U.S. Cl.
CPC *F04D 1/08* (2013.01); *F04D 1/063* (2013.01); *F04D 13/14* (2013.01); *F04D 29/4293* (2013.01)

(58) Field of Classification Search
CPC ..... F04D 1/08; F04D 1/063; F04D 13/14; F04D 29/4293
USPC ..... 415/1, 58.1, 59.1, 93, 99, 100, 101, 415/102, 143, 169.1, 198.1, 203, 204, 205, 415/206; 416/1, 175, 198 R, 199
See application file for complete search history.

(56) References Cited

U.S. PATENT DOCUMENTS

| | | | | | |
|---|---|---|---|---|---|
| 2,833,525 | A * | 5/1958 | Pennington | 415/112 |
| 3,213,798 | A * | 10/1965 | Carswell | 415/175 |
| 3,639,073 | A * | 2/1972 | Beck et al. | 415/109 |
| 4,128,362 | A * | 12/1978 | Shepherd et al. | 415/112 |
| 4,521,151 | A * | 6/1985 | Frater et al. | 415/131 |
| 4,734,019 | A * | 3/1988 | Eberhardt | 415/168.2 |
| 4,799,855 | A * | 1/1989 | Milocco et al. | 415/143 |
| 5,599,164 | A * | 2/1997 | Murray | 415/144 |
| 7,553,124 | B1 * | 6/2009 | Jimenez | 415/99 |

OTHER PUBLICATIONS

BBT/BBT-D Two Stage Radially Split Between Bearings Process Pump ISO 13709 (API 610) Brochure.
Ron Heavy Duty, Two Stage, API 610 Process Pump Brochure.
CUP-BB2T Heavy Duty, Radially Split, Two-Stage Pumps API 610/ISO 13709 Brochure.
Flowserve HED & HED-DS API 610 (BB2) Between Bearings, Two-Stage, Radially Split Pumps Brochure.
Goulds Pumps Goulds 3640 API-610 10th Edition/ISO 13709 API BB2 Two-Stage, Between-Bearing, Radially Split Brochure.

* cited by examiner

*Primary Examiner* — Igor Kershteyn
(74) *Attorney, Agent, or Firm* — Richard A. Fagin

(57) ABSTRACT

A fluid pump includes a primary impeller and a secondary impeller disposed on a common drive shaft within a pump housing. The pump housing including a respective diffuser or volute therein for each of the primary impeller and the secondary impeller. A fluid passage is formed within the housing connecting a discharge of the primary impeller to an intake of the secondary impeller. Each of the primary and secondary impellers has a respective outlet port.

14 Claims, 3 Drawing Sheets

CENTRIFUGAL PUMP WITH SECONDARY IMPELLER AND DUAL OUTLETS

CROSS-REFERENCE TO RELATED APPLICATIONS

Priority is claimed from U.S. Provisional Application No. 61/578,928 filed on Dec. 22, 2011, which application is incorporated herein by reference in its entirety.

STATEMENT REGARDING FEDERALLY SPONSORED RESEARCH OR DEVELOPMENT

Not applicable.

BACKGROUND

U.S. Pat. No. 5,599,164 issued to Murray describes a centrifugal pump with a booster or secondary impeller. The centrifugal pump assembly and a method of using same described in the '164 patent includes a vertical or horizontal overhung housing assembly having a primary inlet, a primary discharge, a secondary inlet and a secondary discharge. A shaft is in spaced relationship within the overhung housing assembly. A single primary impeller is mounted on the shaft for receiving fluid from the primary inlet and discharging fluid through the primary discharge. A booster or secondary impeller is mounted on the shaft proximate the primary impeller for receiving fluid from the secondary inlet and discharging fluid through the secondary discharge. All fluid introduced to the secondary inlet originates from the primary discharge. The fluid in the secondary inlet flows through the booster impeller and discharges through the secondary discharge. The secondary discharge is separate from the primary discharge.

Generally, the pump in the '164 patent requires that the primary discharge connection to the secondary inlet is made using a separate conduit. There exists a need for a simpler, more robust pump having primary and secondary impellers each discharging to a separate outlet.

SUMMARY

One aspect of the disclosure is a fluid pump including a primary impeller and a secondary impeller disposed on a common drive shaft within a pump housing. The pump housing includes a respective volute or diffuser therein for each of the primary impeller and the secondary impeller. A fluid passage is formed within the housing connecting a discharge of the primary impeller to an inlet of the secondary impeller. The housing includes a respective outlet port for each of the primary and secondary impellers.

Other aspects and advantages of the disclosure will be apparent from the description and claims which follow.

DETAILED DESCRIPTION

Figure 1:
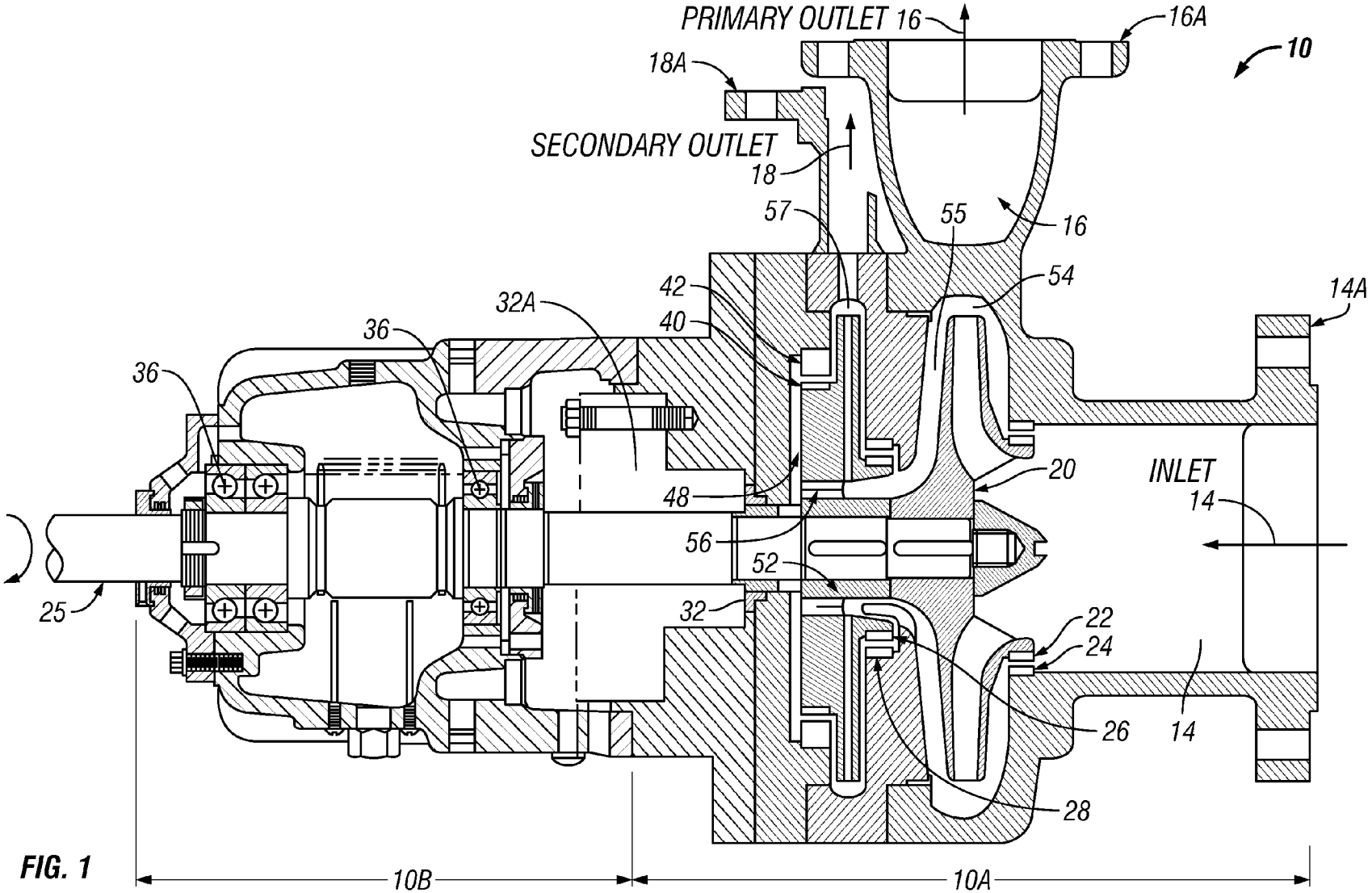
FIG. 1 shows a cut away view of an example overhung pump having impellers in tandem according to the present disclosure.

An example pump according to the invention is shown in cut away view in FIG. 1. The pump 10 may be enclosed in a housing 10A configured to provide necessary enclosure for operation of a primary impeller 20 and a secondary impeller 52. The primary impeller 20 and the secondary impeller 52 may be rotated by a single, common drive shaft 25 rotatably supported in the housing 10A using an overhung bearing bracket 10B with suitable bearings 36. Suitable bearing arrangements may be similar to those, for example, described in U.S. Pat. No. 5,599,164 issued to Murray and incorporated herein by reference. The common drive shaft 25 may be sealed to substantially prevent fluid from moving past the common drive shaft 25 as it passes through a suitable opening in the housing 10A using a seal assembly, for example, as shown at 32A of any type known in the art. The housing 10A may include a bushing 32 or similar device to provide a controlled fluid leakage path between the interior of the housing 10A and the seal assembly 32A. It is to be understood that the described example herein wherein the common driveshaft 25 is overhung from the bearing bracket 10B is only an illustrative example; having the primary 20 and secondary 52 impellers disposed on the common driveshaft 25 disposed between bearings is within the scope of the present invention. One example of such configuration will be further explained with reference to FIG. 2.

The primary impeller 20 may include an inlet or "eye" wear ring 22 thereon disposed to be proximate a first housing wear ring 24 in a suitably formed feature in the housing 10A. The secondary impeller 52 may also include an eye wear ring 26 and corresponding second housing wear ring 28 disposed in a suitable feature in the housing 10A. The secondary impeller 52 may also include a hub wear ring 40 and corresponding third housing wear ring 42. The term "wear ring" is used in the technical field of rotary pumps to describe rings placed in pairs proximate to each other in which one ring in a pair rotates and the other ring in the pair remains stationary. The wear rings in each pair are intended to provide a controlled leakage path across the clearance between the rings in the pair. When properly aligned, the rings in each pair do not contact each other and wear. The rings in each pair may be made from materials having different hardness (e.g., surface hardness) from each other to avoid galling in the event contact between respective wear rings in a pair does take place due to shaft or rotor deflection or other fault in pump operation.

The primary impeller 20 may be disposed in a suitably shaped primary volute or diffuser 54 such that rotation of the primary impeller 20 imparts energy to fluid conducted through an inlet port 14 to a primary outlet port 16 in fluid communication with the primary volute or diffuser 54. The inlet port 14 and primary outlet port 16 may be coupled to respective devices (not shown) for conducting fluid into and out of the pump 10 using suitably shaped flanges 14A, 16A or other coupling feature known in the art.

As shown in FIG. 1, the primary volute or diffuser 54 may include a passage 55 formed in the housing 10A that is in fluid communication with the inlet of the secondary impeller 52. Thus, discharge from the primary impeller 20 may be conducted to both the primary outlet port 16 and to the inlet of the secondary impeller 52.

The secondary impeller 52 may be disposed in a suitably shaped secondary volute or diffuser 57. Rotation of the secondary impeller 52 in the secondary volute or diffuser 57 imparts energy to the fluid conducted through the passage 55 to the secondary impeller 52. Fluid discharge from the secondary impeller 52 may be conducted to a secondary outlet port 18. The secondary outlet port 18 may include a coupling provision such as a flange 18A or other coupling known in the art to couple the secondary outlet port 18 to a suitable device (not shown) that will use the energized fluid from the secondary outlet port 18.

The secondary impeller 52 may include one or more fluid ports 56 proximate the hub thereof to enable passage of fluid under pressure from the outlet side of the primary impeller 50 to a pressure balance annulus 48 disposed between the rear face of the housing 10A and the back shroud of the secondary impeller 52. The dimensions of the pressure balance annulus 48, and the relative shroud areas of the primary impeller 20 and the secondary impeller 52 may be selected to substantially balance axial forces generated by the combination of the primary impeller 20 and the secondary impeller 52.

Figure 2:
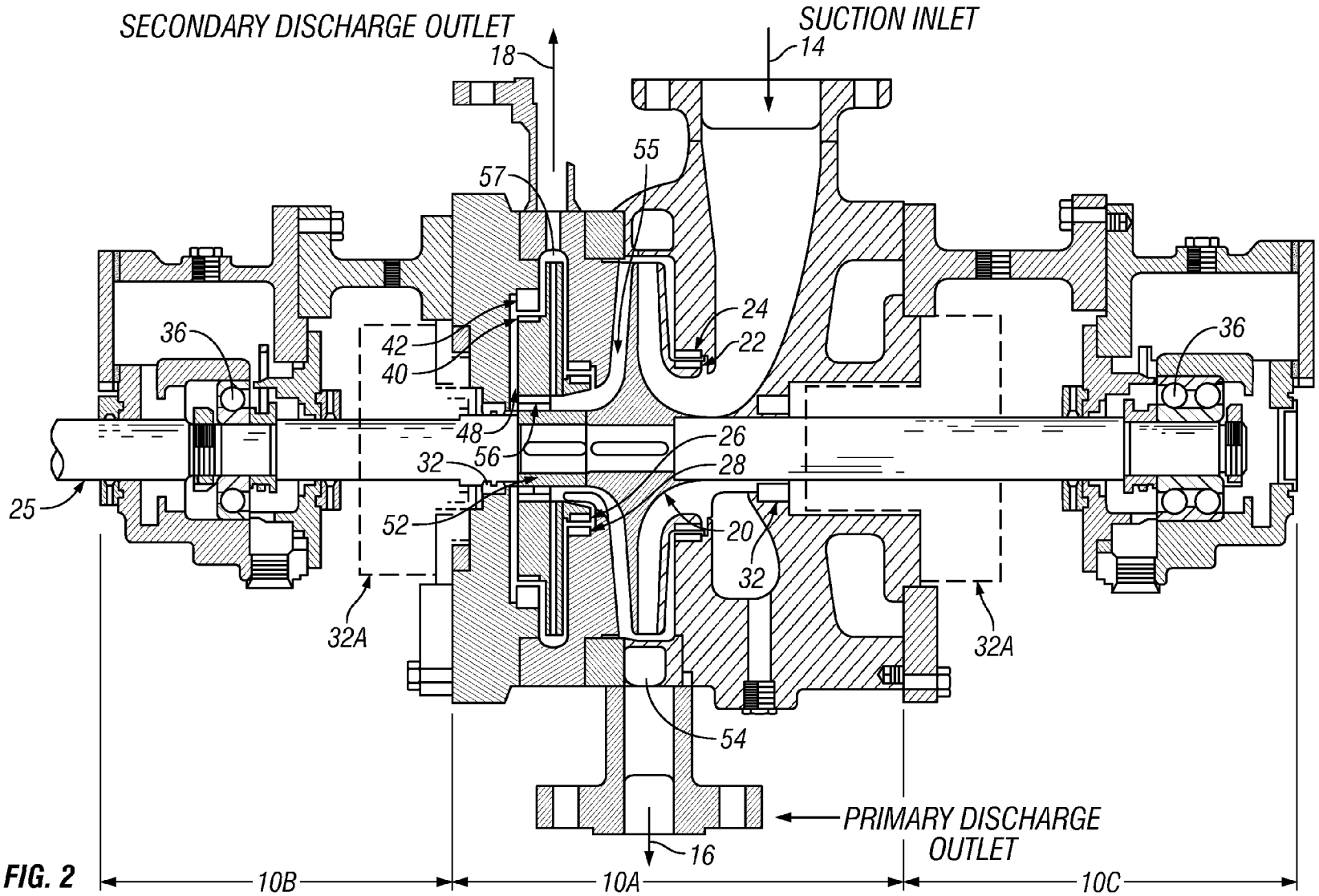
FIG. 2 shows an example of a between bearings pump having impellers in tandem according to the disclosure.

An example of a "between bearings" pump according to one aspect of the present disclosure is shown in FIG. 2. The housing 10A is configured so that bearing brackets 10B, 10C each having suitable bearings 36 to rotatably support the common driveshaft 25 and impellers 20, 52 may be affixed to each longitudinal end of the housing 10A. In order to accommodate such configuration, the primary inlet 14 and associated flange 14A may be located proximate the top of the housing 10A as shown in FIG. 2 to enable longitudinal placement of the bearing bracket 10C as shown. The primary outlet port 16 and associated flange 16A may be disposed on the top of the housing 10A or in a different circumferential orientation than the primary inlet 14. The interior of the housing 10A may be configured similarly to the housing (10A) shown in FIG. 1 and may include a suitably shaped primary volute or diffuser 54, a secondary volute or diffuser 57 each with a corresponding impeller 20, 52 disposed therein. Similarly to the configuration shown in FIG. 1, the housing 10A in FIG. 2 may include an internal passage 55 between the discharge of the primary volute or diffuser 54 and an inlet of the secondary impeller 52. A secondary outlet port 18 and associated flange 18A formed in the housing 10A may be configured as shown in FIG. 2.

Figure 3:
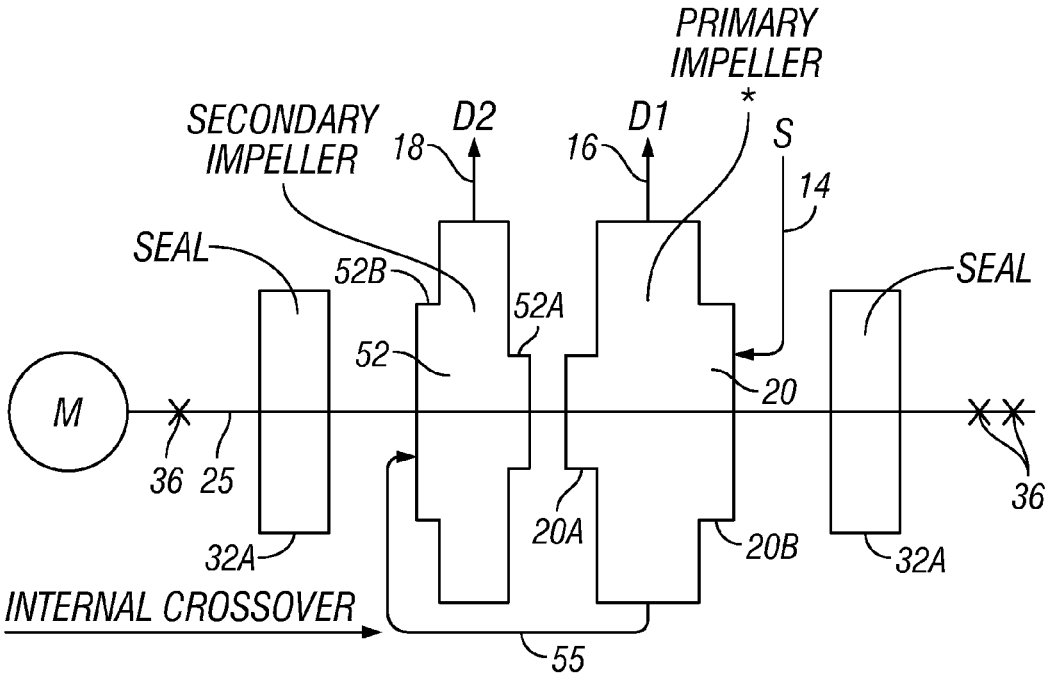
FIG. 3 shows a schematic diagram of a between bearing pump according to the present disclosure having impellers oriented hub to hub.

FIG. 3 shows schematically another configuration of a between bearings pump in which the primary impeller 20 and the secondary impeller 52 are axially balanced with respect to dynamic forces by selection of suitable sizes for the hub 20A, 52A and eye 20B, 52B of each impeller 20, 52, respectively. FIG. 3 shows the impellers 20, 52, shaft 25, bearings 36 and seals 32A schematically without the housings and brackets as in FIG. 2 for simplicity of the illustration. The internal passage between the primary volute or diffuser and the inlet to the secondary impeller 52 is shown schematically at 55. The shaft 25 may be driven by any source of rotational energy such as an electric motor or other type of prime mover 70. The configuration shown in FIG. 3 may be referred to as "hub to hub" because of the relative orientations of the primary impeller 20 and the secondary impeller 52. The primary inlet 14, primary outlet port 16 and secondary outlet port 18 are also shown schematically.

Figure 4:
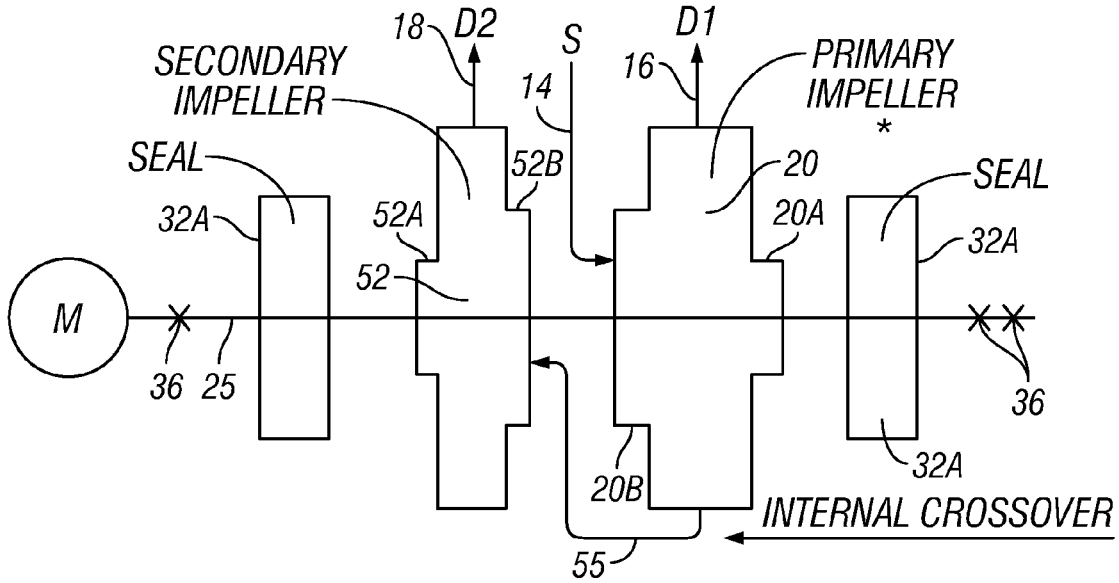
FIG. 4 shows schematic diagram of a different configuration of the pump of FIG. 3 wherein the impellers are oriented eye to eye.

FIG. 4 shows a similar schematic drawing of a different configuration of pump having primary and secondary impellers 20, 52. In FIG. 4, the impellers 20, 52 are oriented in what may be referred to as "eye to eye" configuration. Other components shown in FIG. 4 are similar to those shown in FIG. 3 and are identified with corresponding reference numerals. The primary impellers shown in FIGS. 3 and 4 may be single suction (inlet) type. Double suction primary impellers are known in the art and may be used in other example configurations of a pump according to the present disclosure.

A pump made according to the various aspects of the invention may have one or more of the following advantages over pumps known in the art prior to the present invention. The pump does not require the use of external conduits to couple part of the primary impeller discharge to the inlet of the secondary impeller. The primary impeller may not require the use of back shroud wear rings and related balance ports. In overhung bearing embodiments, the drive shaft cantilever is reduced as compared with prior art overhung bearing pumps, resulting in reduced shaft deflection at the seal and consequent seal wear. A pump according the example shown in FIGS. 1 and 2 uses only three wear ring sets instead of four as do two-impeller pumps known in the art, thus reducing the pump's internal bypass losses. The foregoing reduction in internal bypass losses is an important feature of a pump according to the present invention. By having only three internal clearances in the pump instead of four as in two-impeller overhung pumps known in the art, a pump according to the present invention may provide as much as 40 percent reduction in bypass losses as compared with pumps known in the art.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A fluid pump, comprising:

a primary impeller and a secondary impeller disposed on a common drive shaft within a pump housing, the pump housing including a respective volute or diffuser therein for each of the primary impeller and the secondary impeller;

a fluid passage formed within the housing connecting a discharge of the primary impeller to an intake of the secondary impeller; and a respective fluid outlet port for each of the primary and secondary impellers formed within the housing, wherein secondary impeller comprises at least one fluid port proximate the hub thereof to enable passage of fluid under pressure from a discharge side of the primary impeller to a pressure balance annulus disposed between a rear face of the housing and a back shroud of the secondary impeller and wherein dimensions of the pressure balance annulus and relative shroud areas of the primary impeller and the secondary impeller being such that axial forces generated by the primary impeller and the secondary impeller are substantially balanced.

2. The fluid pump of claim 1 wherein the primary impeller and the secondary impeller comprise three wear ring pairs.

3. The fluid pump of claim 1 wherein the common driveshaft is overhung and is rotatably supported by bearings in a bearing bracket disposed on one longitudinal side of the pump housing.

4. The fluid pump of claim 1 wherein the common driveshaft is rotatably supported by at least one bearing on opposite sides of the primary and secondary impellers, the primary and secondary impellers located longitudinally between each of the at least one bearing on each of the opposite sides.

5. The fluid pump of claim 1 wherein the primary impeller and the secondary impeller are oriented hub to hub.

6. The fluid pump of claim 1 wherein the primary impeller and the secondary impeller are oriented eye to eye.

7. A method for pumping a fluid, comprising:

rotating a primary impeller and a secondary impeller disposed on a common drive shaft within a pump housing, the pump housing including a respective volute or diffuser therein for each of the primary impeller and the secondary impeller;

conducting fluid through a fluid passage formed within the housing connecting a discharge of the primary impeller to an intake of the secondary impeller; and discharging fluid from a respective fluid outlet port from each of the primary and secondary impellers formed within the housing, wherein secondary impeller comprises at least one fluid port proximate the hub thereof to enable passage of fluid under pressure from a discharge side of the primary impeller to a pressure balance annulus disposed between a rear face of the housing and a back shroud of the secondary impeller and wherein dimensions of the pressure balance annulus and relative shroud areas of the primary impeller and the secondary impeller being such that axial forces generated by the primary impeller and the secondary impeller are substantially balanced.

8. The method of claim 7 wherein the primary impeller and the secondary impeller comprise three wear ring pairs.

9. The method of claim 7 wherein the common driveshaft is overhung and is rotatably supported by bearings in a bearing bracket disposed on one longitudinal side of the pump housing.

10. The method of claim 7 wherein the common driveshaft is rotatably supported by at least one bearing on opposite sides of the primary and secondary impellers, the primary and secondary impellers located longitudinally between each of the at least one bearing on each of the opposite sides.

11. The method of claim 7 wherein the primary impeller and the secondary impeller are oriented hub to hub.

12. The method of claim 7 wherein the primary impeller and the secondary impeller are oriented eye to eye.

13. The method of claim 7 wherein the rotating comprises operating a prime mover coupled to the common drive shaft.

14. The method of claim 13 wherein the prime mover comprises an electric motor.

* * * * *